US006406336B1

(12) United States Patent
Stansbury

(10) Patent No.: US 6,406,336 B1
(45) **Date of Patent: *Jun. 18, 2002**

(54) CONTACT WITH ANTI-SKIVING FEATURE

(75) Inventor: Alan L. Stansbury, Carlisle, PA (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/191,609

(22) Filed: Nov. 13, 1998

Related U.S. Application Data

(60) Provisional application No. 60/071,985, filed on Jan. 20, 1998.

(51) Int. Cl.[7] ..... H01R 4/02; H01R 9/24; H01R 13/02

(52) U.S. Cl. ..... 439/876; 439/885

(58) Field of Search ..... 439/876, 885, 439/83; 29/874

(56) References Cited

U.S. PATENT DOCUMENTS

| | | | | |
|---|---|---|---|---|
| 3,838,382 A | | 9/1974 | Sugar | |
| 4,776,651 A | | 10/1988 | Paulo | |
| 5,286,218 A | | 2/1994 | Sakurai et al. | |
| 5,322,461 A | * | 6/1994 | Locati et al. | 439/884 |
| 5,376,026 A | * | 12/1994 | Ohashi | 439/885 |
| 5,692,920 A | | 12/1997 | Banakis et al. | |
| 5,692,928 A | * | 12/1997 | Nelson et al. | 439/733.1 |
| 6,024,584 A | * | 2/2000 | Lemke et al. | 439/78 |

FOREIGN PATENT DOCUMENTS

| | | |
|---|---|---|
| DE | 39 36 414 A | 5/1991 |
| DE | 196 08 168 A | 9/1997 |
| EP | 0 144 128 A | 6/1985 |
| EP | 0 569 893 A | 11/1993 |
| EP | 0598 589 A | 5/1994 |
| EP | 0795 809 A | 9/1997 |
| EP | 0 806814 A | 11/1997 |
| EP | 0 844 550 A | 5/1998 |
| WO | WO/95/35533 | 12/1995 |

OTHER PUBLICATIONS

"Software Copy–Protection Method using Serial No. of Disk Storage", IBM Technical Disclosure Bulletin, vol. 38, No. 12, Dec. 199r (1995–12, pp. 91–92, XP000588081, New York, US, Abstract.

European Search Report No. EP 99 10 1014 Dated Jul. 28, 1999.

* cited by examiner

*Primary Examiner*—Brian Sircus
*Assistant Examiner*—Chandrika Prasad
(74) *Attorney, Agent, or Firm*—Steven M. Reiss; M. Richard Page

(57) ABSTRACT

A contact, insertable into an insulative housing of a connector, has a mating end for receiving a mating contact; a retention portion for insertion into the connector; and a mounting end opposite the mating end. The mounting end has a transition area adapted to pass through the insulative housing without substantially skiving the insulative housing. A method of making a contact, comprising the steps of: providing a sheet of material; stamping the sheet to form a carrier strip having an edge and a plurality of contacts, each having a mounting end extending from the edge of the carrier strip; placing a window in the mounting ends of the contacts; and removing the contacts from said carrier strip.

28 Claims, 6 Drawing Sheets

CONTACT WITH ANTI-SKIVING FEATURE

CROSS-REFERENCE TO RELATED APPLICATIONS

This application claims the benefit of U.S. Provisional Patent Application number 60/071,985 filed on Jan. 20, 1998, herein incorporated by reference.

BACKGROUND OF THE INVENTION

1. Field of the Invention

The present invention relates to a contact with an anti-skiving feature. More specifically, the present invention relates to a contact capable of insertion within a connector housing without substantial skiving of the connector housing.

2. Brief Description of Earlier Developments

When separating contacts from a carrier strip, a cutting tool typically creates a severed edge with a burred region. When the cut-off travels through the connector housing during insertion, the burr skives a layer of material from the retention portion of the connector housing. The skiving of the connector housing may reduce the amount of retention force imparted by the connector housing to retain the contact.

In addition, the portion of the housing skived by the burr may remain on the contact after passing through the connector housing. To remove the skived portion from the contact, the connector assembly process requires an additional step. The connector assembly could use, for example, a brushing step to remove the skived portion from the contact prior to securing a fusible element to the contact. The additional step increases manufacturing costs. Without removal, the skived portion may interfere with the proper attachment of the fusible element to the contact. Thus, the presence of the skived portion is unacceptable, especially in automated applications. Clearly, there is room for improvement in the art.

SUMMARY OF THE INVENTION

It is an object of the present invention to provide a contact that is insertable in a connector housing without skiving the housing.

It is a further object of the present invention to provide a contact that does not retain a skived portion of a connector housing thereon as it is inserted into the housing.

It is a further object of the present invention to provide a contact upon which a fusible element can be attached after the contact has been inserted into a connector housing without the need for a cleaning step.

It is a further object of the present invention to provide a connector that can be assembled in fewer steps.

These and other objects of the present invention are achieved in one aspect of the present invention by a contact. The contact is insertable into an insulative housing of a connector and has a mating end for receiving a mating contact; a retention portion for insertion into the connector; and a mounting end opposite the mating end. The mounting end has a transition area adapted to pass through the insulative housing without substantially skiving the insulative housing.

These and other objects of the present invention are achieved in another aspect of the present invention by a carrier strip. The carrier strip includes: a sheet of material having an edge; and at least one contact. The contact has a mounting end extending from said edge and including a window; a retention portion extending from the mounting end; and a mating end extending from the retention portion.

These and other objects of the present invention are achieved in another aspect of the present invention by a connector. The connector has an insulative housing with at least one aperture therethrough; and a contact insertable within said aperture. The contact has a mating end for receiving a mating contact; a retention portion for engaging the connector; and a mounting end opposite the mating end and having a die controlled region adjacent the retention portion. The die controlled region can pass through the insulative housing of the connector without substantially skiving the insulative housing.

These and other objects of the present invention are achieved in another aspect of the present invention by a method of making a contact. The method includes the steps of: providing a sheet of material; stamping the sheet to form a carrier strip having an edge and a plurality of contacts, each having a mounting end extending from said the of the carrier strip; placing a window in the mounting ends of the contacts; and removing the contacts from said carrier strip.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

Figure 1:
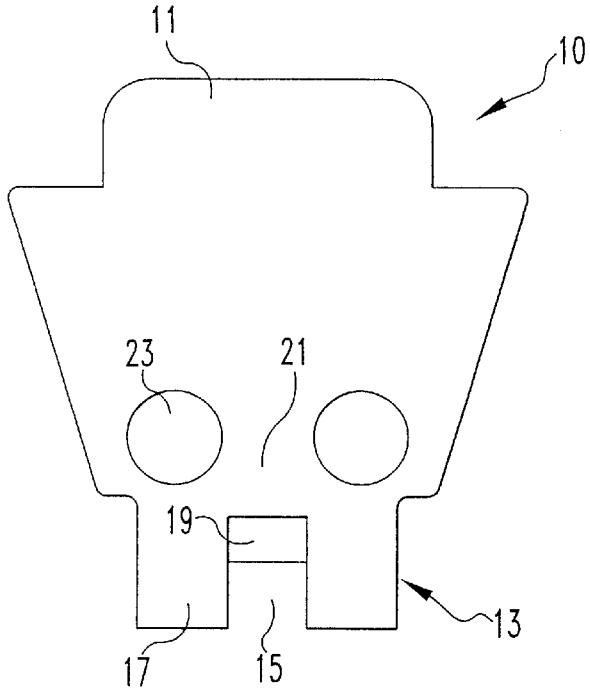
FIG. 1 is an elevational view of one alternative embodiment of a contact of the present invention.

FIG. 1 displays one alternative embodiment of a contact 10 of the present invention. As discussed in more detail below, contact 10 is part of a connector 100.

Contact 10 has a mating end 11 that extends from connector 100 to interact with a corresponding contact (not shown) extending from a mating connector (not shown). As an example, the blade-type contact shown in FIG. 1 preferably interacts with a dual beam contact on the mating connector. However, any type of contact could be used with the present invention.

Figure 4:
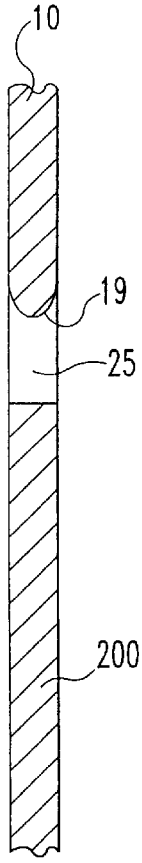
FIG. 4 is a cross-sectional view of a portion of the carrier strip and contact taken along line IV—IV of FIG. 3.

A mounting end 13 opposes mating end 11 of contact 10. Mounting end 13 preferably includes a notch 15 flanked by arms 17. The wall that defines notch 15 includes a generally smooth transition area 19. Transition area 19 is an area of reduced thickness, and preferably has a beveled or an arcuate shape as seen in FIG. 4. Preferably, transition area 19 is located on an area of the wall of notch 15 closest to mating end 11. The benefits of notch 15 and transition area 19 will become more apparent below.

A retention portion 21 extends between mating end 11 and mounting end 13 of connector 10. Retention portion 21 is the portion of contact 10 that interference fits within connector 100. Retention portion 21 may include anti-wicking apertures 23 that helps prevent the possible wicking of solder towards mating end 11 during later manufacturing steps.

Figure 2:
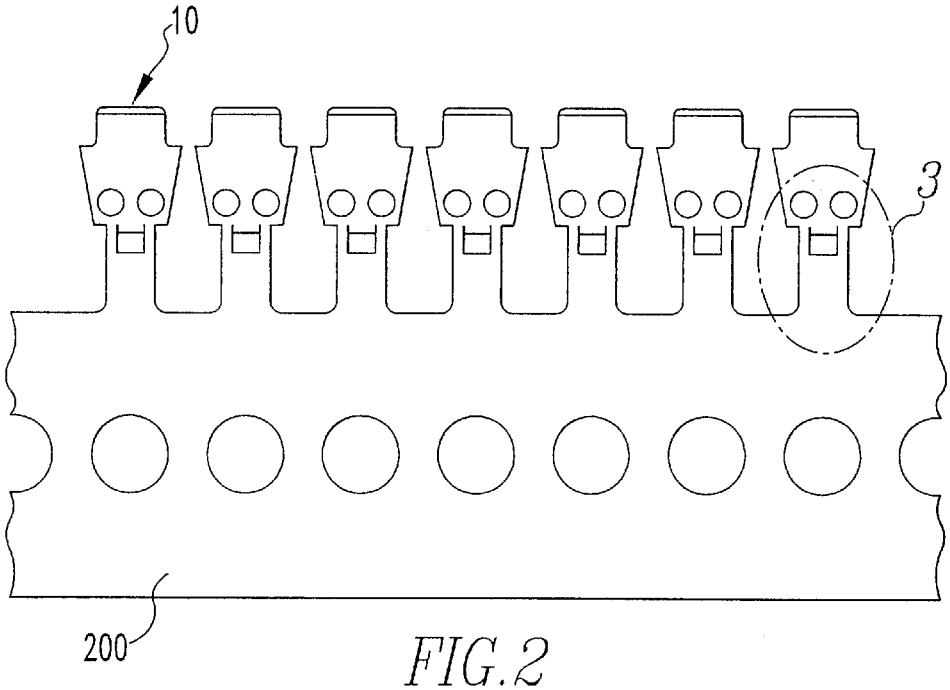
FIG. 2 is a an elevational view of a series of contacts of the present invention on a carrier strip.
Figure 3:
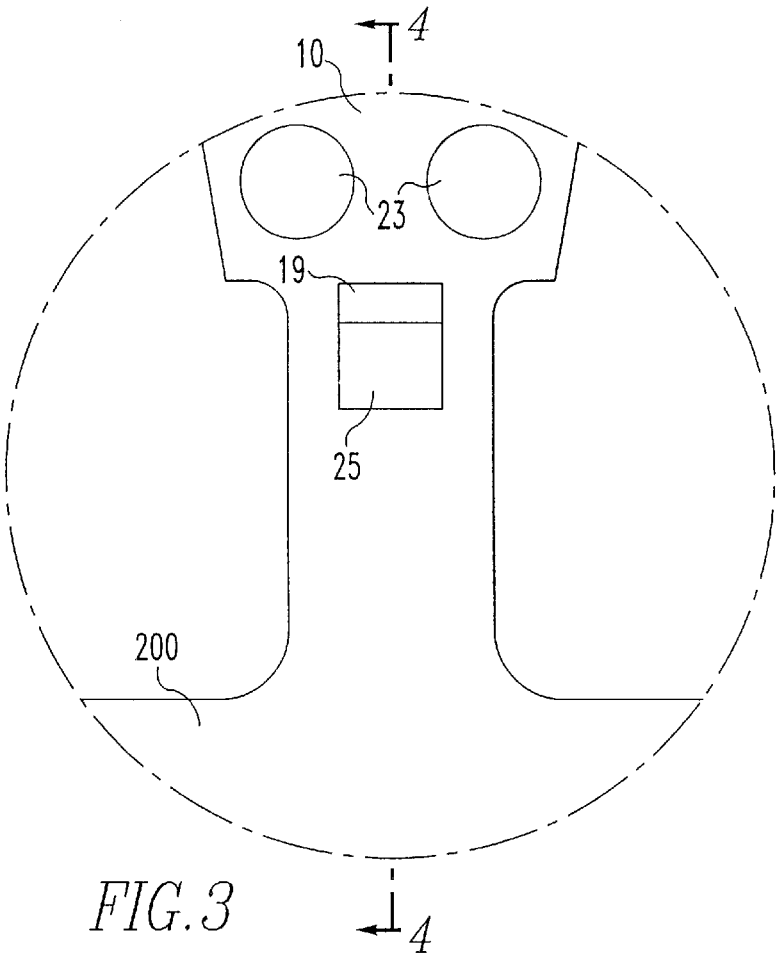
FIG. 3 is an enlarged view of a portion of the carrier strip and contact shown in FIG. 2.

The steps of making contact 10 will now be described with reference to FIGS. 2–4. Machines, such as conventional stamping machines, form a series of contacts 10 on a carrier strip 200. Carrier strip 200 is a sheet of suitable conductive material. In addition to forming the outline of contact 10 and punching anti-wicking apertures 23, the stamping process also forms a window 25 in contact 10.

The portion of the wall that forms window 25 and is located adjacent retention portion 21 is deformed to create transition area 19. Preferably, transition area 19 is a die controlled region. A coining operation preferably forms transition area 19. However, other methods of creating transition area 19 could be used.

After the coining step, a cutting step severs contacts 10 from carrier strip 200, creating discrete contacts. When cut from carrier strip 200, window 25 of contact 10 becomes notch 15. Contacts 10 are placed into connector 100 after severing using known techniques.

Connector 100 will now be described with reference to FIGS. 5–8. Connector 100 includes an insulative housing 101 with an array of apertures 103 extending between a mating surface 105 and a mounting surface 107. Adjacent mating surface 105, each aperture 103 preferably has lead-in surfaces 109, 111. Lead-ins 109, 111 help align contacts 10 with apertures 103 during assembly of connector 100.

Figure 5:
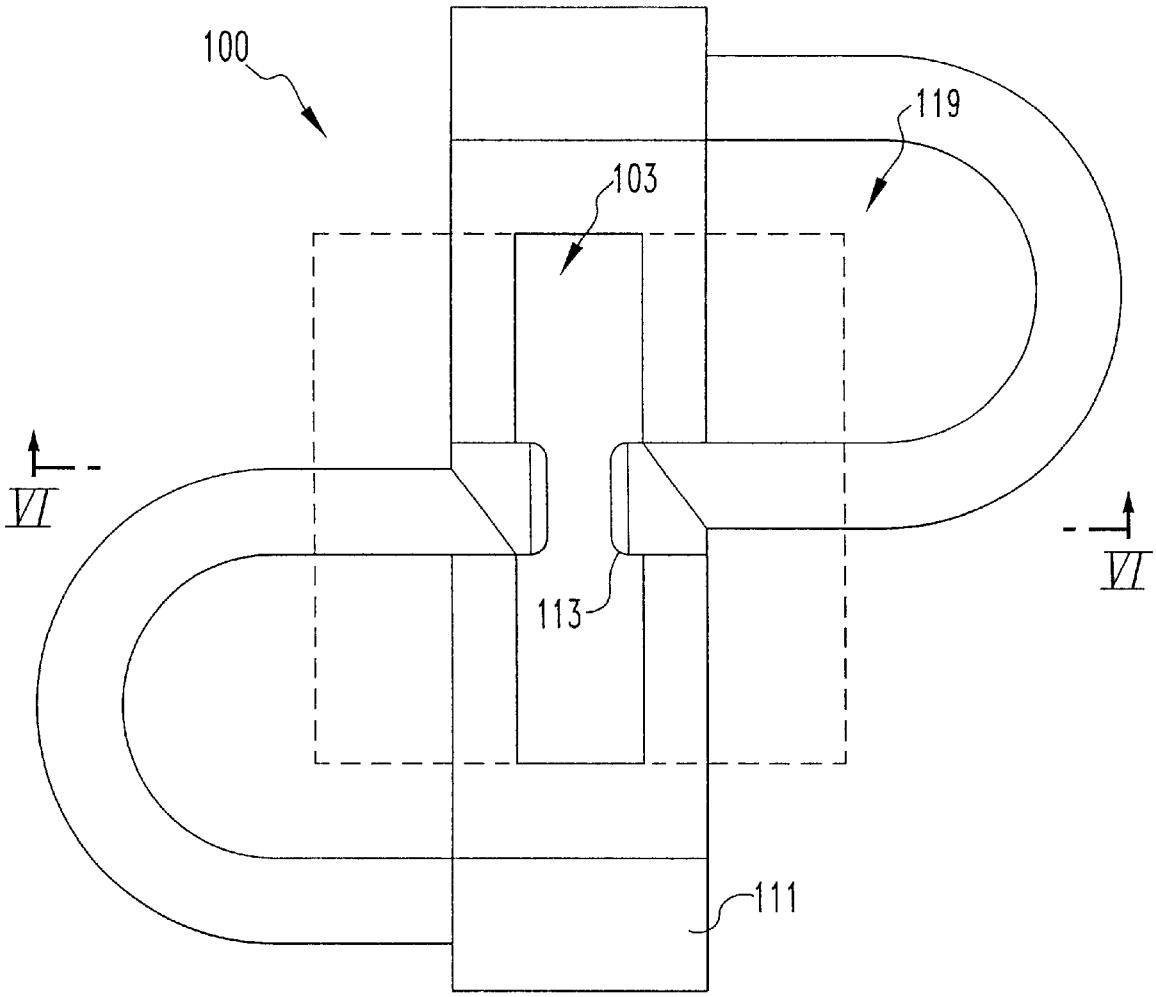
FIG. 5 is a plan view of a portion of connector housing capable of receiving a contact of the present invention.
Figure 6:
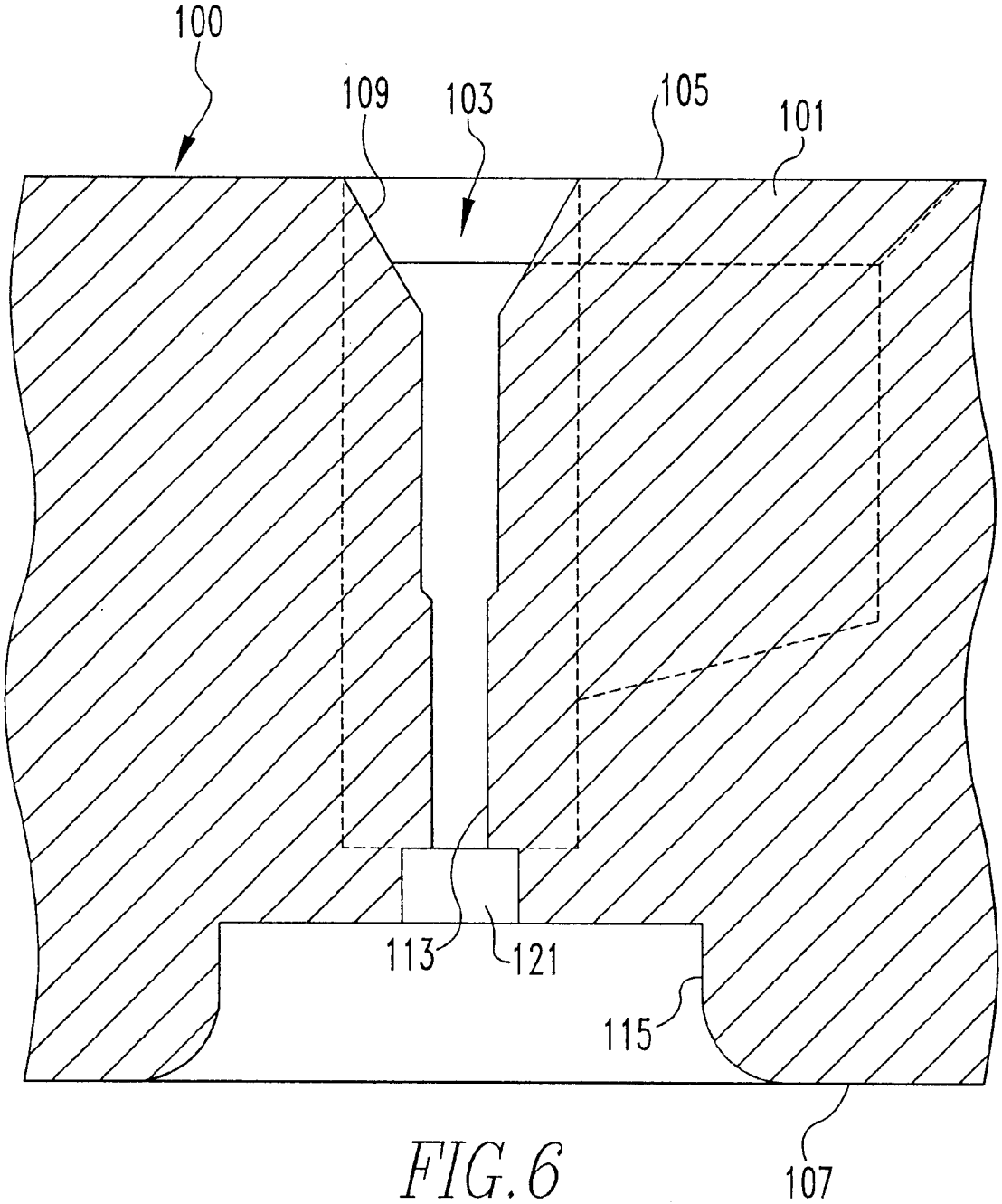
FIG. 6 is a cross-sectional view of a portion of the connector housing taken along line VI—VI of FIG. 5.
Figure 7:
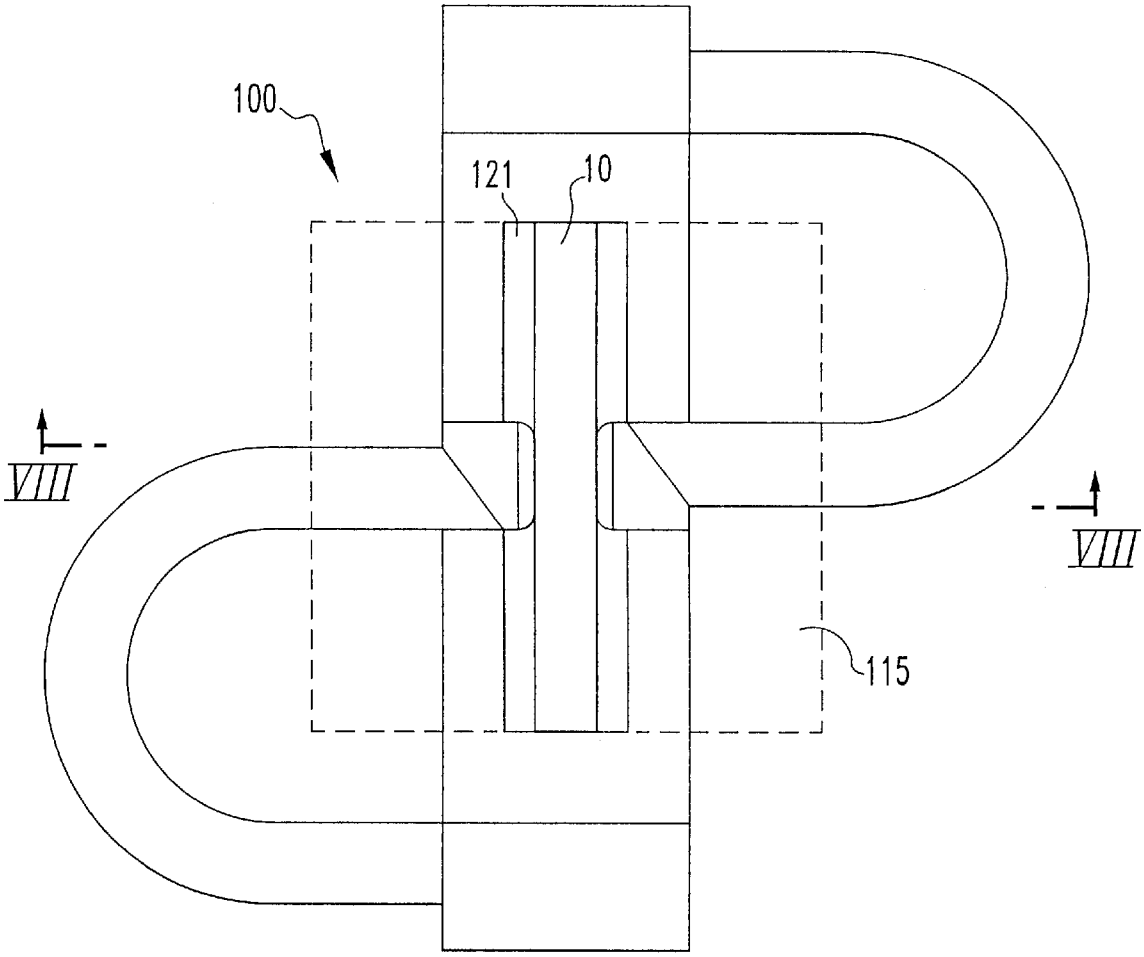
FIG. 7 is a plan view of the portion of the connector housing shown in FIG. 5 with a contact of the present invention inserted therein.
Figure 8:
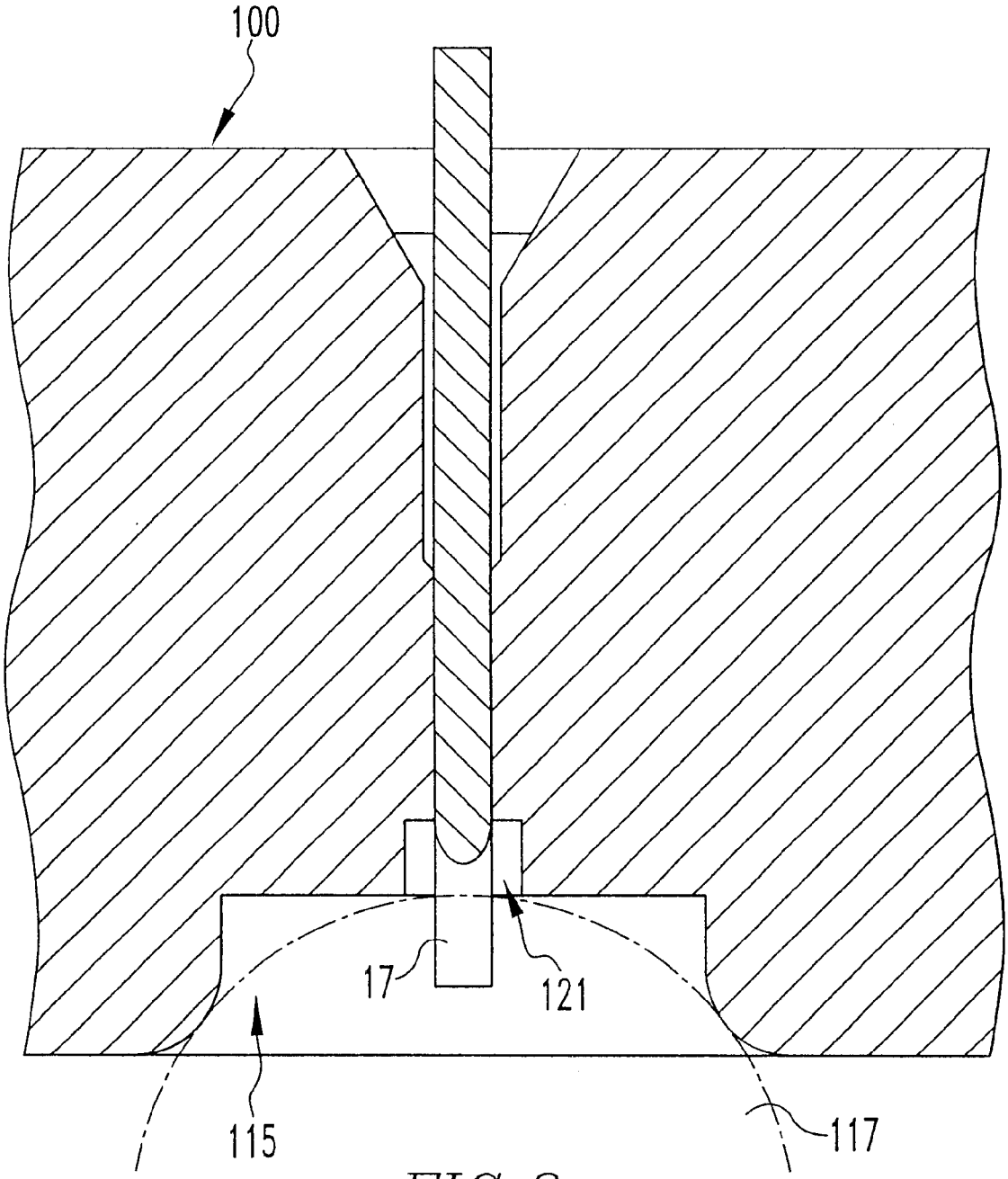
FIG. 8 is a cross-sectional view of the portion of the connector housing and contact taken along line VIII—VIII in FIG. 7.

Apertures 103 also include a reduced width portion between mating surface 105 and mounting surface 107 as seen in FIGS. 6 and 8. The reduced width portion forms a retention zone 113 that retains contact 10 using an interference fit. As shown in FIGS. 5 and 7, retention zone 113 can be a rib that projects inwardly from the walls that form aperture 103. Retention zone 113 can also extend axially along a length of aperture 103. Although shown as a rib, other protuberances could be used to form the reduced width portion.

Since the mating connector preferably has dual beam contacts that mate with contacts 10, insulative housing 101 can include a pair of beam receiving notches 119 that communicate with each aperture 103. Receiving notches 119 can receive the distal ends of the dual beams during mating with contacts 10. Receiving notches 119 are sized to accommodate the deflection of the dual beams when the dual beam contacts mate with contacts 10.

Connector 100 preferably surface mounts to a substrate (not shown) using reflow techniques, preferably Ball Grid Array (BGA) technology. To assist surface mounting, aperture 103 can have an enlarged portion 115 adjacent mounting surface 107. As shown in FIG. 8, enlarged portion 115 serves as a pocket for fusible element 117. In other words, enlarged portion 115 is dimensioned to receive at least a portion of a fusible element 117, such as a solder ball. International Publication number WO 98/15989 (International Application number PCT/US97/18066), herein incorporated by reference, describes methods of securing a solder ball to a contact.

The insertion of contact 10 into connector 100 will now be described with reference to FIGS. 7 and 8. The insertion of contact 10 into connector 100 occurs, using known techniques, after contact 10 is severed from carrier strip 200. Mounting portion 13 of contact 10 enters aperture 103 first. Arms 17 of contact 10 freely pass by retention zone 113 of connector 100 since arms 17 are not aligned with retention zone 113. Transition area 19 of contact 10, however, is aligned with, and engages, retention zone 113 during insertion. Further insertion of contact 10 into connector 100 brings retention portion 21 into engagement with retention zone 113 and, as seen in FIG. 8, places transition area 19 within an auxiliary pocket 121 located between enlarged portion 115 and retention zone 113. Due to its shape, transition area 19 does not skive retention zone 113 during insertion. The insertion of contact 10 into connector 100 can be accomplished with automated techniques.

With contact 10 properly seated in connector 100, fusible element 117 can be attached to contact 10 using, for example, the techniques described in International Publication number WO 98/15989 described above. With the present invention, fusible element 117 can attach to contact 10 without the need for an intermediate step of preparing contact 10, such as brushing the skived portion from contact 10.

Dual arms 17 and notch 15 can help improve the security and placement of fusible element 117 on contact 10. First, dual arms 17 and notch 15 provides more surface area upon which fusible element 117 can attach than with conventional contacts. A larger surface area can increase the bonding force between fusible elements 117 and contacts 10.

In addition, notch 15 can help align fusible element 117 on contact 10. During reflow, fusible element 117 flows into the void area formed by notch 15 even if fusible element 117 is not properly centered on contact 10. The reflow of a portion of fusible element 117 into the void causes the displacement of the remainder of fusible element 117 towards the void area. In other words, fusible element 117 moves towards a centered position during reflow. This helps provide a more uniform connector 100.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A contact insertable into an insulative housing of a connector, comprising:

a mating end for receiving a mating contact;

a retention portion for insertion into the connector; and a mounting end opposite said mating end and having:

a transition area for engaging the insulative housing while passing therethrough without substantially skiving the insulative housing; and a receiving area located further from said retention portion than said transition area to engage a fusible element for securing the contact to a substrate.

2. The contact as recited in claim 1, wherein said transition area is a die controlled region.

3. The contact as recited in claim 2, wherein said die controlled region is coined.

4. The contact as recited in claim 1, wherein said transition area is substantially smooth.

5. The contact as recited in claim 1, wherein said transition area comprises an area of reduced thickness.

6. The contact as recited in claim 5, wherein said area of reduced thickness is tapered.

7. The contact as recited in claim 1, wherein said mounting end further comprises a notch defined by a wall; said transition area occupying at least a portion of said wall.

8. A contact insertable into an insulative housing of a connector, comprising:

a mating end for receiving a mating contact;

a retention portion for insertion into the connector; and a mounting end opposite said mating end and having:

a transition area for engaging the insulative housing while passing therethrough without substantially skiving the insulative housing; and a pair of arms flanking said transition area to engage a fusible element for securing the contact to a substrate.

9. A carrier strip, comprising:

a sheet of material having an edge; and at least one contact, comprising:

a mounting end extending from said edge and including a window with a transition area;

a retention portion extending from said mounting end; and a mating end extending from said retention portion.

10. The carrier strip as recited in claim 9, wherein said transition area is a die controlled region.

11. The carrier strip as recited in claim 10, wherein said die controlled region is coined.

12. The carrier strip as recited in claim 9, wherein said transition area is a deformed area.

13. The carrier strip as recited in claim 12, wherein said deformed area is adjacent said retention portion.

14. The carrier strip as recited in claim 12, wherein said deformed area is substantially smooth.

15. The carrier strip as recited in claim 12, wherein said deformed area is tapered.

16. A connector, comprising:

an insulative housing with at least one aperture therethrough; and a contact insertable within said aperture and comprising:

a mating end for receiving a mating contact;

a retention portion for engaging the connector; and a mounting end opposite said mating end and having:

a die controlled region adjacent said retention portion and engaging the insulative housing while passing therethrough without substantially skiving the insulative housing;

a receiving area located further from said retention portion than said die controlled region for engaging a fusible element for securing the contact to a substrate.

17. The connector as recited in claim 16, wherein said die controlled region is coined.

18. The connector as recited in claim 16, wherein said die controlled region is tapered.

19. The connector as recited in claim 18, wherein said die controlled region is rounded.

20. The connector as recited in claim 16, wherein said mounting end further comprises a notch defined by a wall; said die controlled region occupying at least a portion of said wall.

21. A connector, comprising:

an insulative housing with at least one aperture therethrough; and a contact insertable within said aperture and comprising:

a mating end for receiving a mating contact;

a retention portion for engaging the connector; and a mounting end opposite said mating end and having:

a die controlled region adjacent said retention portion for engaging the insulative housing while passing therethrough without substantially skiving the insulative housing;

a pair of arms flanking said die controlled region to engage a fusible element for securing the contact to a substrate.

22. The connector as recited in claim 16, further comprising a fusible element attachable to said contact.

23. An electrical connector, comprising:

a housing having an opening with a width; and a contact insertable in said opening and including a transition area having a distal end with a thickness generally less than said width and a proximal end with a thickness generally greater than said width;

wherein, during insertion of said contact in said housing, said distal end enters said opening before said proximal end, said transition area engaging said opening while passing therethrough without substantially skiving said housing, and said transition area remaining within said housing after insertion.

24. The electrical connector as recited in claim 23, further comprising a fusible element secured to said contact after insertion of said contact in said housing, wherein said transition area is substantially without any material skived from said housing during insertion of said contact in said housing which may interfere with the retention of said fusible element on said contact.

25. An electrical connector, comprising:

a housing, including:

an opening; and a retention feature extending into said opening and adapted to engage only a portion of a contact inserted therein; and a contact insertable in said opening, including:

a retention section;

a transition section aligned with said retention section so that, during insertion of said contact in said housing, said transition section engages said retention feature before said retention section engages said retention feature; and a receiving section for engaging a fusible element to secure the connector to a substrate;

wherein said receiving section does not engage said retention feature, and said transition section passes through said retention feature without substantially skiving said housing.

26. The electrical connector as recited in claim 25, wherein said retention feature is a rib.

27. The electrical connector as recited in claim 25, wherein said transition section and said retention section are aligned in a longitudinal direction of said contact.

28. The electrical connector as recited in claim 27, wherein said transition section and said retention section are aligned along a longitudinal centerline of said contact.

* * * * *